US006066604A

United States Patent [19]

Kaneko

[11] Patent Number: 6,066,604

[45] Date of Patent: May 23, 2000

[54] VACUUM PUMP OIL

[75] Inventor: Masato Kaneko, Ichihara, Japan

[73] Assignee: Idemitsu Kosan Co., Ltd., Tokyo, Japan

[21] Appl. No.: 09/131,687

[22] Filed: Aug. 10, 1998

[30] Foreign Application Priority Data

Sep. 1, 1997 [JP] Japan ..... 9-235778

[51] Int. Cl.[7] ..... C10M 105/04; C10M 101/02; C10M 133/04; C10M 129/10

[52] U.S. Cl. ..... 508/548; 508/563; 508/584

[58] Field of Search ..... 508/548, 563, 508/584

[56] References Cited

U.S. PATENT DOCUMENTS 4,317,948 3/1982 Heckelsberg ..... 585/329

5,372,703 12/1994 Kamiya et al. ..... 208/58

*Primary Examiner*—Jerry D. Johnson

*Attorney, Agent, or Firm*—Oblon, Spivak, McClelland, Maier & Neustadt, P.C.

[57] ABSTRACT

Disclosed is a vacuum pump oil, of which the base oil substantially comprises hydrocarbons having a molecular weight of not smaller than 300, and has a viscosity index of not smaller than 120 and a dynamic viscosity at 40° C. of from 10 to 500 $mm^2$/sec. The vacuum pump oil has good thermal stability and good capabilities to produce high ultimate vacuum degrees and to facilitate low-temperature starting of pumps. Using this, vacuum pumps can be rapidly started and can reach the steady-state driving condition even in winter and in cold districts.

14 Claims, No Drawings

VACUUM PUMP OIL

FIELD OF THE INVENTION

The present invention relates to vacuum pump oil, precisely to that having good thermal stability and good capabilities to produce high ultimate vacuum degrees and to facilitate low-temperature starting of pumps.

BACKGROUND OF THE INVENTION

Vacuum technology is widely utilized in various fields of semiconductor production, solar cells, aircraft, automobiles and optoelectronics. For this, widely known are mechanical vacuum pumps such as piston vacuum pumps, rotary vacuum pumps, etc.; and high-vacuum pumps such as oil-rotation vacuum pumps, oil-diffusion vacuum pumps, etc. Various synthetic oil based and mineral oil based vacuum pump oils are used for lubricating the sliding parts of those vacuum pumps, for ensuring high vacuum degrees and for prolonging the pump life.

With the recent developments in their application field, vacuum pumps are required to have high thermal stability and to attain high vacuum degrees. For this, various improvements have heretofore been made in vacuum pump oils. In addition, in the application field of vacuum technology, it is desired to shorten the time from the starting of vacuum pumps to the steady-state driving thereof in order to increase the producibility in the art. However, the low-temperature starting capabilities of conventional vacuum oils are often poor. Therefore, when they are used in winter or in cold districts, they take a long period of time before they reach the steady-state driving condition. For these reasons, there are various problems with conventional vacuum pump oils in that the producibility of intended products is low and that products of stable quality could not be obtained.

SUMMARY OF THE INVENTION

The present invention has been made in consideration of the viewpoints noted above, and its object is to provide vacuum pump oil having good thermal stability and good capabilities to produce high ultimate vacuum degrees and to facilitate low-temperature starting of pumps. In particular, the object is to provide vacuum pump oil that ensures rapid steady-state driving of vacuum pumps even in winter and in cold districts.

To attain the object, the present invention provides a vacuum pump oil, of which the base oil substantially comprises hydrocarbons having a molecular weight of not smaller than 300, and has a viscosity index of not smaller than 120 and a dynamic viscosity at 40° C. of from 10 to 500 $mm^2/sec$.

DETAILED DESCRIPTION OF THE INVENTION

The invention is described in detail hereinunder with reference to its preferred embodiments.

The base oil of the vacuum pump oil of the invention substantially comprises hydrocarbons having a molecular weight of not smaller than 300, and has a viscosity index of not smaller than 120. The material of the base oil includes synthetic oil and mineral oil.

As the synthetic oil, for example, usable are poly-α-olefins. The poly-α-olefins may be generally polymers to be obtained by homo-polymerizing any one of linear or branched α-olefins having from4 to 14 carbon atoms, or by co-polymerizing two or more of them. The starting α-olefins preferably have from 10 to 14, more preferably from 12 to 14 carbon atoms. For example, the poly-α-olefins can be obtained by homo-polymerizing 1-decene, 1-dodecene, 1-tetradecene or the like, orby co-polymerizing two or more of them. As specific examples of the polymers, mentioned are trimers, tetramers, pentamers and hexamers of 1-dodecene and/or 1-tetradecene. Especially preferred are trimers, tetramers and pentamers of 1-dodecene, and dimers, trimers and tetramers of 1-tetradecene.

Poly-α-olefins of those types can be produced by polymerizing α-olefins in the presence of a catalyst. The catalyst includes, for example, Friedel-Crafts catalysts such as aluminium chloride, boron fluoride, etc.; and Ziegler catalysts. More preferably, the poly-α-olefins are hydrogenated to saturate the unsaturated bonds. For the hydrogenation, for example, the polymers may be contacted with hydrogen in the presence of a nickel-based, palladium-based or platinum-based hydrogenation catalyst.

Apart from those noted above, polymers of internal olefins are also usable as the synthetic oil. The polymers of internal olefins can be produced by homo-polymerizing any one of linear or branched internal olefins having from 4 to 14 carbon atoms, or by co-polymerizing two or more of them. The starting internal olefins preferably have from 10 to 14, more preferably from 12 to 14 carbon atoms. For example, the polymers are obtained by homo-polymerizing or copolymerizing 7-tetradecene, etc. As specific examples of the polymers, mentioned are trimers, tetramers, pentamers and hexamers of 7-tetradecene. More preferably, the polymers of internal olefins are hydrogenated to saturate the unsaturated bonds.

The mineral oil for use in the invention includes, for example, paraffinic mineral oils, naphthenic mineral oils, intermediate-base mineral oils, etc. As specific examples of those oils, mentioned are light neutral oils, medium-gravity neutral oils, heavy neutral oils, bright stocks and others as produced through solvent purification or hydrogenation purification. Especially preferred are paraffinic mineral oils such as isoparaffins.

The base oil for use in the invention substantially comprises hydrocarbons having a molecular weight of not smaller than 300. Vacuum pump oil of which the base oil contains hydrocarbons having a molecular weight of smaller than 300 could not have good capabilities to produce high ultimate vacuum degrees and to facilitate low-temperature starting of pumps. The wording "substantially" as referred to herein means that the vacuum pump oil of the invention may contain minor amounts of any other base oil components and impurities without detracting from the effect of the invention. More preferably, the amount of hydrocarbons having a molecular weight of smaller than 450 in the base oil for use in the invention is not larger than 30% by weight, since the vacuum pump oil comprising the base oil has better capabilities to facilitate low-temperature starting of pumps and has better lubricating ability.

Mineral oil and synthetic oil to be the material of the base oil are generally mixtures of hydrocarbons having different molecular weights. As the case may be, therefore, the amount of hydrocarbons having a molecular weight of smaller than 300 to be in those oils will have to be quantitated. Also, the amount of hydrocarbons having a molecular weight of smaller than 450 to be therein will have to be quantitated. In those cases, oils may be subjected to gas chromatography, GPC or the like to quantitate the amount of such hydrocarbons therein. In GPC, for example, calibration curves are prepared for standard compounds of which the molecular weight is known. Based on the calibration curves, the smallest molecular weight of hydrocarbons in oils can be determined. In addition, from the ratio of the area for hydrocarbons having a molecular weight of smaller than 450 in the GPC charts of oils, the amount of hydrocarbons having a molecular weight of smaller than 450 in the oils can be determined.

Oils containing hydrocarbons having a molecular weight of smaller than 300 shall be subjected to fractionation such as distillation or the like, and the fractions that satisfy the requirement of the invention are selected. The same fractionation such as distillation of the like shall apply to oils in order to obtain fractions in which the amount of hydrocarbons having a molecular weight of smaller than 450 is not larger than 30% by weight.

Preferably, the base oil for use in the invention has a molecular weight distribution (this is represented by Mw/Mn with Mw being a weight-average molecular weight and Mn being a number-average molecular weight) of from 1 to 1.1. The molecular weight distribution may be determined through GPC or the like. The base oil having such a narrow molecular weight distribution is preferred, since the vacuum pump oil comprising it has good capabilities to facilitate low-temperature starting of pumps. In general, the base oil to be used in the invention has a molecular weight of from 300 to 1200.

The base oil for use in the invention has a viscosity index, as measured according to JIS K 2283, of not smaller than 120, but generally falling between 120 and 170. Vacuum pump oil of which the base oil has a viscosity index of smaller than 120 could not be stably used within a broad temperature range of from low temperatures to high temperatures. On the other hand, base oil having a viscosity index of larger than 170 is generally difficult to produce, and is not economical. Preferably, the base oil for use in the invention has a viscosity index of from 130 to 170. Base oil materials are suitably selected and formulated into the base oil having a viscosity index of not smaller than 120 for use in the invention.

The base oil for use in the invention has a dynamic viscosity at 40° C., as measured according to JIS K 2283, of from 10 to 500 $mm^2$/sec, but preferably from 20 to 200 $mm^2$/sec. Base oil having a too high dynamic viscosity is unfavorable, its viscosity at low temperatures is too high resulting in that the capabilities of the vacuum pump oil comprising it to facilitate low-temperature starting of pumps are poor. On the contrary, base oil having a too low dynamic viscosity is also unfavorable, since the sliding parts of vacuum pumps such as rotors and vanes thereof for which it is used, will be much worn. It is desirable that the pour point of the base oil, which is an index for the low-temperature fluidity thereof, is not higher than 10° C., more preferably not higher than −10° C., in order that the vacuum pump oil can be used in winter and in cold districts. The base oil for use in the invention generally has a weight-average molecular weight of from 310 to 1000.

The vacuum pump oil of the invention comprises one or more base oils noted above either singly or as combined. If desired, it may contain any ordinary additives for lubricating oil, such as antioxidants, precipitation inhibitors, rust inhibitors, viscosity index improvers, etc., for the purpose of further improving the capabilities of the vacuum pump oil.

The antioxidants include phenolic antioxidants, amine-type antioxidants, sulfur-type antioxidants, and phosphorus-type antioxidants.

Phenolic antioxidants include mono-phenolic antioxidants, bis-phenolic antioxidants, poly-phenolic antioxidants, and phenolic natural antioxidants. Mono-phenolic antioxidants include, for example, 2,6-di-tert-butylphenol, n-octadecyl-3-(4-hydroxy-3',5' di-tert-butylphenyl)propionate, distearyl(4-hydroxy-3-methyl-5-tert-butyl)benzyl malonate, 6-(4-hydroxy-3,5-di-tert-butylanilino)2,4-bisoctyl-thio-1,3,5-triazine. Bis-phenolic antioxidants include, for example, ester bond including compounds, amide bond including compounds, and sulfide bond including compounds. Actual compounds of bis-phenolic antioxidants include, for example, 2,2'-methylenebis(4-methyl-6-nonylphenol), 4,4'-thiobis(2-methyl-6-tert-butylphenol), 4,4'-methylenebis (2,6-di-t-butylphenol). Poly-phenolic antioxidants include isocyanurate bond including compounds such as tris (3,5-di-tert-butyl-4-hydroxyphenol)cyanurate. Phenolic natural antioxidants include, for example, tocopherol.

Sulfur-type antioxidants include thioester-type antioxidants and sulfur containing metallic complex such as zinc diamyldithiocarbamate.

Amine-type antioxidants include, for example, monooctyldiphenylamine, dioctylphenylamine, phenyl-α-naphthylamine, N,N'-di-β-naphthyl-p-phenylenediamine, etc.

Desirably, the antioxidants may be selected from phenolic antioxidants and amine-type antioxidant. Desirably, the antioxidants have a molecular weight of not smaller than 300. Desirably, the antioxidants may be added to the vacuum pump oil in an amount of from 0.01 to 5% by weight, more desirably from 0.05 to 3% by weight, relative to the total weight of the oil.

The precipitation inhibitors include, for example, non-ionic surfactants such as polyethylene glycol, polypropylene glycol, polyethylene glycol-polypropylene glycol block copolymers, etc. Desirably, these may be added to the vacuum pump oil in an amount of from 0.01 to 5% by weight, more desirably from 0.05 to 3% by weight, relative to the total weight of the oil.

The rust inhibitors include, for example, alkenylsuccinic acid monooleates, polyamides, barium sulfonate, benzotriazole derivatives, etc. Desirably, these may be added to the vacuum pump oil in an amount of from 0.01 to 5% by weight, more desirably from 0.05 to 3% by weight, relative to the total weight of the oil.

The viscosity index improvers include, for example, polymethyl methacrylates, polyisobutylenes, ethylene-propylene copolymers, styrene-isoprene copolymers, hydrogenated styrene-butadiene copolymers, etc. Desirably, these may be added to the vacuum pump oil in an amount of from 0.1 to 10% by weight, more desirably from 0.2 to 5% by weight, relative to the total weight of the oil.

The invention is described in more detail with reference to the following Examples, which, however, are not intended to restrict the scope of the invention.

Methods for Testing Products for Their Properties in Examples and Comparative Examples (1) Thermal Stability Test:

According to JIS K 2540, each sample was heated at 170° C. for 24 hours, and the evaporation loss was measured.

(2) Ultimate Vacuum Degree:

JIS B 8316 was referred to. A sample of vacuum pump oil to be tested was filled into the compressor of a rotary vacuum pump, and the pump was started. The vacuum degree at the suction mouth was measured. When it became constant at the oil temperature of 50° C., the value was read. This is the ultimate vacuum degree of the pump.

(3) Differential Thermal Analysis:

JIS K 0129 was referred to. Using Seiko Electronic Industry's TG/DTA200 (trade name), 5 mg of a sample was heated from room temperature at a heating rate of 10° C./min, and the temperature for 5% weight loss was read.

(4) Low-temperature Starting Capability:

A rotary vacuum pump with a sample of vacuum pump oil was kept at an ambient temperature of 10° C., and was started, whereupon the time from its starting to its steady-state driving (at a vacuum degree of up to $1\times10^{-3}$ mmHg) was measured. The sample for which the time was within 2 minutes was excellent; and that for which the time was within 5 minutes was good.

(5) RBOT (Rotating Bomb Oxidation Test) Value:

RBOT value is an index for oxidation and deterioration of vacuum pump oil, for which referred to was JIS K 2514. The time (minutes) before the end point of pressure depression was measured for each sample.

(6) Lubricating Ability (wear test)

SAE-3135/AIS1-C-1137 was used as the pin/block material. Pin/block was set in a Falex testing machine, and 100 g of a sample of oil to be tested was filled into the test container. The pin/block was rotated at a revolution of 290 rpm, at an oil temperature of 50° C. and under a load of 200 Lbs for 60 minutes, and the abrasion loss in the pin was measured.

EXAMPLE 1

Poly-α-olefin, Idemitsu Petrochemical's PA05010, which was obtained by polymerization and hydrogenation of an α-olefin, was used as a base oil (A1). Through its gas chromatography, the base oil was found to be comprised of 49% by weight of tetramer hydrogenate of 1-decene, 37% by weight of pentamer hydrogenate thereof and 14% by weight of hexamer hydrogenate thereof. The molecular weight distribution of the base oil was measured through GPC. The dynamic viscosity at 40° C. of the base oil was measured according to JIS K 2283; and the viscosity index thereof was according to JIS K 2283. The base oil A1 was used as vacuum pump oil, and subjected to the tests noted above for its capabilities. The data obtained are shown in Table 1-1.

EXAMPLE 2

Poly-α-olefin, Idemitsu Petrochemical's PA05008, which was obtained by polymerization and hydrogenation of an α-olefin, was used as abase oil (A2). This was analyzed in the same manner as in Example 1, and was found to be comprised of 6% by weight of trimer hydrogenate of 1-decene, 58% by weight of tetramer hydrogenate thereof, 29% by weight of pentamer hydrogenate thereof, and 7% by weight of hexamer hydrogenate thereof. The physical properties of the base oil were determined in the same manner as in Example 1. The base oil A2 was used as vacuum pump oil, and subjected to the tests noted above for its capabilities. The data obtained are shown in Table 1-1.

EXAMPLE 3

Poly-α-olefin, Idemitsu Petrochemical's PA05006, which was obtained by polymerization and hydrogenation of an α-olefin, was used as a base oil (A3). This was analyzed in the same manner as in Example 1, and was found to be comprised of 34% by weight of trimer hydrogenate of 1-decene, 44% by weight of tetramer hydrogenate thereof, 18% by weight of pentamer hydrogenate thereof, and 4% by weight of hexamer hydrogenate thereof. The physical properties of the base oil were determined in the same manner as in Example 1. The base oil A3 was used as vacuum pump oil, and subjected to the tests noted above for its capabilities. The data obtained are shown in Table 1-1.

EXAMPLE 4

The tetramer hydrogenate of 1-dodecene as obtained through distillation of a 1-dodecene polymer hydrogenate was used as a base oil (A4). Its dynamic viscosity and viscosity index were measured in the same manner as in Example 1. The base oil A4 was used as vacuum pump oil, and subjected to the tests noted above for its capabilities. The data obtained are shown in Table 1-1.

EXAMPLE 5

The trimer hydrogenate of 1-dodecene as obtained through distillation of a 1-dodecene polymer hydrogenate was used as a base oil (A5). Its physical properties were determined in the same manner as in Example 4. The base oil A5 was used as vacuum pump oil, and subjected to the tests noted above for its capabilities. The data obtained are shown in Table 1-1.

EXAMPLE 6

The dimer hydrogenate of 1-dodecene as obtained through distillation of a 1-dodecene polymer hydrogenate was used as a base oil (A6). Its physical properties were determined in the same manner as in Example 4. The base oil A6 was used as vacuum pump oil, and subjected to the tests noted above for its capabilities. The data obtained are shown in Table 1-2.

EXAMPLE 7

The trimer hydrogenate of 1-tetradecene as obtained through distillation of a 1-tetradecene polymer hydrogenate was used as a base oil (A7). Its physical properties were determined in the same manner as in Example 4. The base oil A7 was used as vacuum pump oil, and subjected to the tests noted above for its capabilities. The data obtained are shown in Table 1-2.

EXAMPLE 8

The dimer hydrogenate of 7-tetradecene as obtained through distillation of a 7-tetradecene polymer hydrogenate was used as a base oil (A8). Its physical properties were determined in the same manner as in Example 4. The base oil A8 was used as vacuum pump oil, and subjected to the tests noted above for its capabilities. The data obtained are shown in Table 1-2.

EXAMPLE 9

A base oil (B1) obtained through distillation of an isoparaffinic mineral oil was used as vacuum pump oil, and subjected to the tests noted above for its capabilities. The molecular weight distribution, the dynamic viscosity and the viscosity index of the base oil B1 were measured in the same manner as in Example 1. To determine the smallest molecular weight of the components constituting the base oil B1, prepared was a calibration curve of standard compounds of which the molecular weight was known, through GPC. The GPC chart of the base oil B1 was compared with the calibration curve prepared, and the smallest molecular weight was obtained from the first-appeared peak in the chart. In the base oil B1, the amount of the components having a molecular weight of smaller than 450 was also obtained on the basis of the same calibration curve, and this was derived from the ratio of the area for the components with a molecular weight of smaller than 450 in the GPC chart of the base oil B1. The data obtained are shown in Table 1-2.

EXAMPLE 10

A base oil (B2) obtained through distillation of an isoparaffinic mineral oil was used as vacuum pump oil, and subjected to the tests noted above for its capabilities. The physical properties of the base oil B2 were determined in the same manner as in Example 9. The data obtained are shown in Table 1-2.

EXAMPLE 11

A predetermined amount (shown in Table 1-3) of an antioxidant, dioctylphenylamine (C1) was added to the base oil A1 to prepare a vacuum pump oil. This was subjected to the tests noted above for its capabilities. The data obtained are shown in Table 1-3.

EXAMPLE 12

A predetermined amount (shown in Table 1-3) of an antioxidant, 4,4'-methylenebis (2,6-di-t-butylphenol) (C2) was added to the base oil A1 to prepare a vacuum pump oil. This was subjected to the tests noted above for its capabilities. The data obtained are shown in Table 1-3.

EXAMPLE 13

A predetermined amount (shown in Table 1-3) of an antioxidant, n-octadecyl-3-(4-hydroxy-3',5' di-tert-butylphenyl)propionate (C3) was added to the base oil A1 to prepare a vacuum pump oil. This was subjected to the tests noted above for its capabilities. The data obtained are shown in Table 1-3.

EXAMPLE 14

A predetermined amount (shown in Table 1-4) of an antioxidant, 2,2'-methylenebis(4-methyl-6-nonylphenol) (C4) was added to the base oil A1 to prepare a vacuum pump oil. This was subjected to the tests noted above for its capabilities. The data obtained are shown in Table 1-4.

EXAMPLE 15

A predetermined amount (shown in Table 1-4) of an antioxidant, 4,4'-thiobis (2-methyl-6-tert-butylphenol) (C5) was added to the base oil A1 to prepare a vacuum pump oil. This was subjected to the tests noted above for its capabilities. The data obtained are shown in Table 1-4.

EXAMPLE 16

A predetermined amount (shown in Table 1-4) of an antioxidant, tris (3,5-di-tert-butyl-4-hydroxyphenol) cyanurate (C6) was added to the base oil A1 to prepare a vacuum pump oil. This was subjected to the tests noted above for its capabilities. The data obtained are shown in Table 1-4.

EXAMPLE 17

A predetermined amount (shown in Table 1-4) of an antioxidant, tocopherol (C7) was added to the base oil A1 to prepare a vacuum pump oil. This was subjected to the tests noted above for its capabilities. The data obtained are shown in Table 1-4.

EXAMPLE 18

A predetermined amount (shown in Table 1-4) of an antioxidant, zinc diamyldithiocarbamate (C8) was added to the base oil A1 to prepare a vacuum pump oil. This was subjected to the tests noted above for its capabilities. The data obtained are shown in Table 1-4.

EXAMPLE 19

A predetermined amount (shown in Table 1-5) of an antioxidant, N,N'-di-β-naphthyl-p-phenylenediamine (C9) was added to the base oil A1 to prepare a vacuum pump oil. This was subjected to the tests noted above for its capabilities. The data obtained are shown in Table 1-5.

COMPARATIVE EXAMPLE 1

A vacuum pump oil D1 of mineral oil (this is a commercially-available product) was subjected to the tests noted above for its capabilities. In the same manner as in Example 9, the smallest molecular weight and the amount of components having a molecular weight of smaller than 450 in D1, as well as the dynamic viscosity and the viscosity index of D1 were determined. The data obtained are shown in Table 1-3.

COMPARATIVE EXAMPLE 2

A vacuum pump oil D2 of alkylbenzene synthetic oil (this is a commercially-available product) was subjected to the tests noted above for its capabilities. In the same manner as in Example 9, the physical properties of D2 were determined. The data obtained are shown in Table 1-3.

COMPARATIVE EXAMPLE 3

A 1-decene dimer was used as a base oil (D3). The physical properties of D3 were determined in the same manner as in Example 4. The base oil D3 was used as vacuum pump oil, and was subjected to the tests noted above for its capabilities. The data obtained are shown in Table 1-5.

COMPARATIVE EXAMPLE 4

A vacuum pump oil D4 of mineral oil (this is a commercially-available product) was subjected to the tests noted above for its capabilities. In the same manner as in Example 9, the physical properties of D2 were determined. The data obtained are shown in Table 1-5.

TABLE 1-1

| | | Example 1 | Example 2 | Example 3 | Example 4 | Example 5 |
|---|---|---|---|---|---|---|
| Composition | Base Oil | A1 | A2 | A3 | A4 | A5 |
| | Antioxidant | — | — | — | — | — |
| Formulation | Base Oil | 100 | 100 | 100 | 100 | 100 |
| (wt. %) | Antioxidant | — | — | — | — | — |
| Base Oil | Smallest Molecular Weight | 562 | 422 | 422 | 674 | 506 |
| | Amount of Components with molecular weight of smaller than 450 (wt. %) | 0 | 6 | 34 | 0 | 0 |
| | Molecular Weight Distribution | 1.05 | 1.05 | 1.05 | 1 | 1 |
| | Dynamic Viscosity at 40° C. ($mm^2$/sec) | 68 | 47 | 32 | 50 | 38 |
| | Viscosity Index | 135 | 135 | 135 | 137 | 137 |
| Evaporation Loss (wt. %) | | 1.0> | 1.0> | 1.0> | 1.0> | 1.0> |
| Ultimate Vacuum Degree (mmHg) | | $5 \times 10^{-4}$> | $5 \times 10^{-4}$> | $5 \times 10^{-4}$> | $5 \times 10^{-4}$> | $5 \times 10^{-4}$> |
| Differential Thermal Analysis, temperature (° C.) for 5% weight loss | | 300< | 300< | 300< | 300< | 300< |
| Low-temperature Starting | Time (min) | 1.1 | 1.6 | 2.3 | 0.9 | 1.0 |
| Capability | Evaluation | Excellent | Excellent | Good | Excellent | Excellent |
| Lubricating Capability, abrasion loss in pin (mg) | | 1> | 1> | 2 | 1> | 1 |
| RBOT Value (min) | | — | — | — | — | — |

TABLE 1-2

| | | Example 6 | Example 7 | Example 8 | Example 9 | Example 10 |
|---|---|---|---|---|---|---|
| Composition | Base Oil | A1 | A2 | A3 | A4 | A5 |
| | Antioxidant | — | — | — | — | — |
| Formulation | Base Oil | 100 | 100 | 100 | 100 | 100 |
| (wt. %) | Antioxidant | — | — | — | — | — |
| Base Oil | Smallest Molecular Weight | 338 | 590 | 394 | 380 | 310 |
| | Amount of Components with molecular weight of smaller than 450 (wt. %) | 100 | 0 | 100 | 29 | 35 |
| | Molecular Weight Distribution | 1 | 1 | 1 | 1.1 | 1.1 |
| | Dynamic Viscosity at 40° C. ($mm^2$/sec) | 28 | 47 | 32 | 68 | 32 |
| | Viscosity Index | 137 | 137 | 137 | 146 | 143 |
| Evaporation Loss (wt. %) | | 1.9 | 1.0> | 1.0> | 1.5 | 2.1 |
| Ultimate Vacuum Degree (mmHg) | | $5 \times 10^{-4}$> | $5 \times 10^{-4}$> | $5 \times 10^{-4}$> | $5 \times 10^{-4}$> | $5 \times 10^{-4}$> |
| Differential Thermal Analysis, temperature (° C.) for 5% weight loss | | 280 | 300< | 290 | 270 | 242 |
| Low-temperature Starting | Time (min) | 4.1 | 1.2 | 2.2 | 1.5 | 2.7 |
| Capability | Evaluation | Good | Excellent | Good | Excellent | Good |
| Lubricating Capability, abrasion loss in pin (mg) | | 2 | 1> | 1 | 1> | 2 |
| RBOT Value (min) | | — | — | — | — | — |

TABLE 1-3

| | | Comparative Example 1 | Comparative Example 2 | Example 11 | Example 12 | Example 13 |
|---|---|---|---|---|---|---|
| Composition | Base Oil | D1 | D2 | A1 | A1 | A1 |
| | Antioxidant | — | — | C1 | C2 | C3 |
| Formulation | Base Oil | 100 | 100 | 99.7 | 99.7 | 99.7 |
| (wt. %) | Antioxidant | — | — | 0.3 | 0.3 | 0.3 |
| Base Oil | Smallest Molecular Weight | 240 | 250 | 562 | 562 | 562 |
| | Amount of Components with molecular weight of smaller than 450 (wt. %) | 35 | 40 | 0 | 0 | 0 |
| | Molecular Weight Distribution | — | — | 1.05 | 1.05 | 1.05 |
| | Dynamic Viscosity at 40° C. ($mm^2$/sec) | 56 | 38 | 68 | 68 | 68 |
| | Viscosity Index | 100 | −32 | 133 | 133 | 133 |
| Evaporation Loss (wt. %) | | 8.5 | 6.9 | 1.0> | 1.0> | 1.0> |
| Ultimate Vacuum Degree (mmHg) | | $5 \times 10^{-2}$ | $5 \times 10^{-2}$ | $5 \times 10^{-4}$> | $5 \times 10^{-4}$> | $5 \times 10^{-4}$> |
| Differential Thermal Analysis, temperature (° C.) for 5% weight loss | | 198 | 205 | — | — | — |
| Low-temperature Starting | Time (min) | not shorter | not shorter | 1.2 | 1.2 | 1.2 |

TABLE 1-3-continued

| | | Comparative Example 1 | Comparative Example 2 | Example 11 | Example 12 | Example 13 |
|---|---|---|---|---|---|---|
| Capability | | than 10 min | than 10 min | | | |
| | Evaluation | Bad | Bad | Excellent | Excellent | Excellent |
| Lubricating Capability, abrasion loss in pin (mg) | | 1> | 1 | 1> | 1> | 1> |
| RBOT Value (min) | | 30 | 35 | 250 | 250 | 260 |

TABLE 1-4

| | | Example 14 | Example 15 | Example 16 | Example 17 | Example 18 |
|---|---|---|---|---|---|---|
| Composition | Base Oil | A1 | A1 | A1 | A1 | A1 |
| | Antioxidant | C4 | C5 | C6 | C7 | C8 |
| Formulation | Base Oil | 99.7 | 99.7 | 99.7 | 99.7 | 99.7 |
| (wt. %) | Antioxidant | 0.3 | 0.3 | 0.3 | 0.3 | 0.3 |
| Base Oil | Smallest Molecular Weight | 562 | 562 | 562 | 562 | 562 |
| | Amount of Components with molecular weight of smaller than 450 (wt. %) | 0 | 0 | 0 | 0 | 0 |
| | Molecular Weight Distribution | 1.05 | 1.05 | 1.05 | 1.05 | 1.05 |
| | Dynamic Viscosity at 40° C. ($mm^2$/sec) | 68 | 68 | 68 | 68 | 68 |
| | Viscosity Index | 133 | 133 | 133 | 133 | 133 |
| Evaporation Loss (wt. %) | | 1.0> | 1.0> | 1.0> | 1.0> | 1.0> |
| Ultimate Vacuum Degree (mmHg) | | $5 \times 10^{-4}$> | $5 \times 10^{-4}$> | $5 \times 10^{-4}$> | $5 \times 10^{-4}$> | $5 \times 10^{-4}$> |
| Differential Thermal Analysis, temperature (° C.) for 5% weight loss | | — | — | — | — | — |
| Low-temperature Starting | Time (min) | 1.2 | 1.2 | 1.2 | 1.2 | 1.2 |
| Capability | Evaluation | Excellent | Excellent | Excellent | Excellent | Excellent |
| Lubricating Capability, abrasion loss in pin (mg) | | 1> | 1> | 1> | 1> | 1> |
| RBOT Value (min) | | 300 | 340 | 350 | 250 | 270 |

TABLE 1-5

| | | Example 19 | Comparative Example 3 | Comparative Example 4 |
|---|---|---|---|---|
| Composition | Base Oil | A1 | D3 | D4 |
| | Antioxidant | C9 | — | — |
| Formulation | Base Oil | 99.7 | 100 | 100 |
| (wt. %) | Antioxidant | 0.3 | — | — |
| Base Oil | Smallest Molecular Weight | 562 | 282 | 142 |
| | Amount of Components with molecular weight of smaller than 450 (wt. %) | 0 | 100 | 45 |
| | Molecular Weight Distribution | 1.05 | 1 | 1.5 |
| | Dynamic Viscosity at 40° C. ($mm^2$/sec) | 68 | 20 | 32 |
| | Viscosity Index | 133 | 132 | 110 |
| Evaporation Loss (wt. %) | | 1.0> | 7.2 | 10.5 |
| Ultimate Vacuum Degree (mmHg) | | $5 \times 10^{-4}$> | $2 \times 10^{-2}$ | $5 \times 10^{-1}$ |
| Differential Thermal Analysis, temperature (° C.) for 5% weight loss | | — | — | — |
| Low-temperature Starting | Time (min) | 1.2 | 7.5 | not shorter than 10 min |
| Capability | Evaluation | Excellent | Bad | Bad |
| Lubricating Capability, abrasion loss in pin (mg) | | 1> | 5 | 2 |
| RBOT Value (min) | | 320 | — | — |

From the data of Examples and Comparative Examples, noted are the following. The evaporation loss in the samples of Examples is smaller than that in the samples of Comparative Examples. This means that the thermal stability of the samples of Examples is better than that of the samples of Comparative Examples. The samples of Examples gave a higher ultimate vacuum degree than those of Comparative Examples. This means that the vacuum pumps using the samples of Examples may have a higher vacuum degree than those using the samples of Comparative Examples. In addition, the capabilities of the samples of Examples to facilitate low-temperature starting of pumps are better than those of the samples of Comparative Examples. This means that the vacuum pumps using the samples of Examples can reach the steady-state driving condition within a shorter period of time at low temperatures than those using the samples of Comparative Examples. From those data, it is known that the vacuum pump oil of the invention is favorable to practical use of vacuum pumps with it, and that the producibility of vacuum pumps using the oil of the invention is much improved. In addition, it is further known that the vacuum pump oil of the invention has good lubricating capabilities.

In particular, the vacuum pump oil of the invention, of which the base oil contains hydrocarbon having a molecular weight of smaller than 450 in an amount of not larger than 30% by weight, has much better capabilities to produce high ultimate vacuum degrees and to facilitate low-temperature starting of pumps.

The vacuum pump oil of the invention which additionally contains an antioxidant has a high RBOT value.

As having such excellent capabilities, the vacuum pump oil of the invention is widely used for mechanical vacuum pumps, oil-rotation vacuum pumps, oil-diffusion vacuum pumps, etc.

The vacuum pump oil of the invention has good thermal stability and good capabilities to produce high ultimate vacuum degrees and to facilitate low-temperature starting of pumps.

What is claimed is:

1. A vacuum pump oil composition, comprising 95 to 99.99% of a base oil which substantially comprises hydrocarbons having a molecular weight of not smaller than 300, and has a viscosity index of not smaller than 120 and a dynamic viscosity at 40° C. of from 10 to 500 $mm^2$/sec and from 0.01 to 5% by weight of an antioxidant selected from the group consisting of amine-containing antioxidants and phenolic antioxidants.

2. The vacuum pump oil as claimed in claim 1, wherein the amount of hydrocarbons having a molecular weight of smaller than 450 in the base oil is not larger than 30% by weight.

3. The vacuum pump oil as claimed in claim 2, wherein the base oil has a molecular weight distribution of from 1 to 1.1.

4. The vacuum pump oil as claimed in claim 2, wherein the base oil is a mineral oil.

5. A vacuum pump using the vacuum pump oil of claim 2.

6. The vacuum pump oil as claimed in claim 1, wherein the base oil has a molecular weight distribution of from 1 to 1.1.

7. The vacuum pump oil as claimed in claim 1, wherein the base oil is a poly-α-olefin as produced through polymerization of α-olefins having from 10 to 14 carbon atoms.

8. The vacuum pump oil as claimed in claim 7, wherein the α-olefins have from 12 to 14 carbon atoms.

9. The vacuum pump oil as claimed in claim 7, wherein the poly-α-olefin is a trimer, tetramer or pentamer of 1-dodecene.

10. The vacuum pump oil as claimed in claim 7, wherein the poly-α-olefin is a trimer, tetramer or pentamer of 1-tetradecene.

11. The vacuum pump oil as claimed in claim 1, wherein the base oil is a mineral oil.

12. The vacuum pump oil as claimed in claim 11, wherein the base oil is an isoparaffinic mineral oil.

13. The vacuum pump oil as claimed in claim 11, wherein the antioxidant has a molecular weight of not smaller than 300.

14. A vacuum pump using the vacuum pump oil of claim 1.

* * * * *